US007413835B2

(12) United States Patent
Lin et al.

(10) Patent No.: US 7,413,835 B2
(45) Date of Patent: Aug. 19, 2008

(54) IMAGING MEMBERS

(75) Inventors: Liang-Bih Lin, Rochester, NY (US); Robert C. U. Yu, Webster, NY (US); Francisco Lopez, Rochester, NY (US); Jin Wu, Webster, NY (US); John S. Chambers, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 481 days.

(21) Appl. No.: 11/181,966

(22) Filed: Jul. 14, 2005

(65) Prior Publication Data

US 2007/0015073 A1 Jan. 18, 2007

(51) Int. Cl.
*G03G 15/02* (2006.01)

(52) U.S. Cl. ..... 430/58.05; 430/58.75; 430/133

(58) Field of Classification Search ..... 430/58.05, 430/58.75, 133
See application file for complete search history.

(56) References Cited

U.S. PATENT DOCUMENTS

| | | | | |
|---|---|---|---|---|
| 4,233,384 | A | 11/1980 | Turner et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,299,897 | A | 11/1981 | Stolka et al. | |
| 4,306,008 | A | 12/1981 | Pai et al. | |
| 4,338,387 | A | 7/1982 | Hewitt | |
| 4,439,507 | A | 3/1984 | Pan et al. | |
| 4,664,995 | A | 5/1987 | Horgan et al. | |
| 5,069,993 | A | 12/1991 | Robinette et al. | |
| 5,096,795 | A | 3/1992 | Yu | |
| 5,830,614 | A | 11/1998 | Pai et al. | |
| 5,863,685 | A * | 1/1999 | DeFeo et al. | 430/58.35 |
| 6,183,921 | B1 * | 2/2001 | Yu et al. | 430/58.7 |
| 6,326,111 | B1 | 12/2001 | Chambers et al. | |
| 6,337,166 | B1 | 1/2002 | Chambers et al. | |
| 2004/0214100 | A1 * | 10/2004 | Yu et al. | 430/58.8 |

* cited by examiner

*Primary Examiner*—Mark A Chapman
(74) *Attorney, Agent, or Firm*—Eugene O. Palazzo; Fay Sharpe LLP

(57) ABSTRACT

An electrophotographic imaging member having a thermoplastic charge transport layer comprising a charge transport compound, a polycarbonate polymer binder, a particulate dispersion, and a high boiler compatible organic liquid. The disclosed charge transport layer exhibits enhanced wear resistance, excellent photoelectrical properties, and good print quality.

19 Claims, 5 Drawing Sheets

IMAGING MEMBERS

BACKGROUND

This disclosure relates, in various embodiments, to electrostatographic imaging members. More particularly, the disclosure relates to an improved outermost exposed imaging layer, such as a charge transport layer, of an electrostatographic imaging member which extends the mechanical service life of the member.

Electrostatographic imaging members are known in the art. Typical electrostatographic imaging members include photoreceptors for electrophotographic imaging systems and electroreceptors such as ionographic imaging members for electrographic imaging systems. Generally, these imaging members comprise at least a supporting substrate and at least one imaging layer comprising a thermoplastic polymeric matrix material. In a photoreceptor, the photoconductive imaging layer may comprise only a single photoconductive layer or a plurality of layers such as a combination of a charge generating layer and one or more charge transport layer(s).

Electrostatographic imaging members can have a number of different configurations. For example, they can comprise a flexible member, such as a flexible scroll or a belt containing a flexible substrate support. The flexible member belt may be seamed or unseamed. The electrostatographic imaging members can also be a rigid member, such as those utilizing a rigid support substrate drum. Drum imaging members have a rigid cylindrical supporting substrate bearing one or more imaging layers. Although the present disclosure is equally applicable to imaging members of any configuration, for reasons of simplicity, the disclosure herein after will focus primarily on and represent flexible electrophotographic imaging members such as a flexible seamed belt.

Flexible electrophotographic imaging member belts are typically fabricated from a sheet which is cut from a web. The sheets are generally rectangular in shape. The edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic welding is generally the more desirable method of joining because it is rapid, clean (no solvents) and produces a thin and narrow seam. In addition, ultrasonic welding is more desirable because it causes generation of heat at the contiguous overlapping end marginal regions of the sheet to maximize melting of one or more layers therein to produce a strong fusion bonded seam.

A typical flexible electrophotographic imaging member belt comprises at least one photoconductive insulating layer. It is imaged by uniformly depositing an electrostatic charge on the imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member or substrate such as paper.

A number of current flexible electrophotographic imaging members are multilayered photoreceptors that, in a negative charging system, comprise a substrate support, an electrically conductive layer, an optional charge blocking layer, an optional adhesive layer, a charge generating layer, and a charge transport layer. In such an imaging member, the charge transport layer is the top outermost layer exposed to the environment. Since flexible electrophotographic imaging members exhibit upward curling after completion of the application of a charge transport layer, an anti-curl back coating can also be employed on the back side of the flexible substrate support (the side opposite from the electrically active layers) to achieve the desired photoreceptor belt flatness.

In normal machine design, the flexible photoreceptor belt is mounted over and around a belt support module. As such, the belt is constantly subjected to bending strain as it flexes over each of the belt module support rollers during dynamic belt cyclic motion. The greatest bending strain is tension concentrated at the surface of the charge transport layer, so that extended belt cyclic flexing has been found to facilitate the development of surface cracking. In this regard, surface cracking in the charge transport layer is somewhat unique only in belt photoreceptors and is induced, in part, due to the effect of dynamic fatigue of the belt flexing over the supporting rollers of a machine belt support module.

Surface cracking has also been found to be caused by exposure to airborne chemical contaminants as the photoreceptor segments statically "park" or directly bend over the rollers after periods of photoreceptor belt non-use during machine idling. Typical chemical contaminants include solvent vapors, environment airborne pollutants, and corona species emitted by machine charging subsystems. Surface cracking can also be exacerbated by the combination of fatigue belt flexing and airborne chemical exposure. Photoreceptor surface cracking is a critical mechanical issue seen in imaging members, particularly in flexible belts, because the cracks manifest themselves into printout defects that seriously impact copy quality.

Similarly, under normal machine electrophotographic imaging processing conditions, the top outermost exposed charge transport layer is constantly subjected to mechanical interactions against machine subsystems and components. These include, for example, sliding cleaning blade and cleaning brush actions, corona species exposure, toner debris, developer components, toner image receiving papers, and the like. Consequently, the charge transport layer is also susceptible to surface scratching, abrasion, wear, and filming which produce copy print-out defect problems as well.

Each charge transport layer-of a multi-layered photoreceptor is typically formed by a solution coating process. The coating solutions generally contain an organic solvent(s), such as methylene chloride or a chlorinated solvent. After application of the coating solution, the wet coating layer is dried at elevated temperatures to remove a substantial amount of the solvent to produce a solid layer. However, not all of the solvent may be removed from the coating layer during drying. For example, in forming a typical charge transport layer from a coating solution containing about 86 weight-% (wt-%) methylene chloride solvent and 14 wt-% dissolved solids, the solvent evaporates very quickly during the elevated temperature drying process. However, about 2 wt-% of the methylene chloride will typically still be present or trapped in the resulting charge transport layer (i.e., residual methylene chloride). The trapped solvent evaporates or "outgases" over time. The outgassing of the trapped solvent from the charge transport layer during storage and over the life of the photoreceptor causes dimensional contraction of the charge transport layer, causing increased internal strain in the charge transport layer. Thus, in addition to the bending strain induced during dynamic photoreceptor belt flexing over each belt module support roller in a machine, this increase in internal strain will exacerbate charge transport layer cracking under normal belt functioning conditions in the field.

Dimension contraction in the charge transport layer also causes the photoreceptor belt to exhibit upward curling at both edges when the belt functions in a machine. Since the contraction in belt direction is prevented by the applied tension as the belt is mounted over and around a belt support module, edge curling in the photoreceptor belt is an important issue. Edge curling changes the distance between the belt surface and the charging device, causing non-uniform surface charging density which is visible as a "smile print" defect. Such a defect is characterized by higher intensity print-images at the locations over both belt edges.

Since the charge transport layer of a typical negatively charged multilayered photoreceptor flexible belt is typically the outermost exposed layer, it is inevitably subjected to constant mechanical interactions against various electrophotographic imaging machine subsystems under a normal service environment. These mechanical interactions include abrasive contact with cleaning and/or spot blades, exposure to toner particles, carrier beads, toner image receiving substrates, etc. As a result, the charge transport layer may frequently exhibit mechanical failures such as frictional abrasion, wear, and surface cracking due to fatigue dynamic belt flexing. Under normal functioning conditions, exposure to the ozone species generated from the wires of a charging device is known to cause polymer binder chain scission, exacerbating charge transport layer cracking and wear problems. Charge transport layer wear is also an issue because wear reduces thickness and thereby alters the equilibrium of the balancing forces between the charge transport layer and the anti-curl back coating, impacting imaging member flatness. Moreover, in a rigid electrophotographic imaging member drum design utilizing a contact AC Bias Charging Roller (BCR), ozone species attack on the charge transport layer polymer binder is more pronounced because of the close vicinity of the BCR to the charge transport layer of the imaging member drum. As a consequence, charge transport layer wear is a serious problem which significantly reduces the functional life of the imaging member.

To resolve one or more of the above-noted shortcomings and issues, a method of fabricating electrophotographic imaging members to produce robust mechanical charge transport layer function has been investigated and successfully demonstrated as described below. The imaging members produced thereby exhibit good wear resistance, cracking life extension, and durability. Such imaging members exhibit enhanced physical/mechanical service life.

REFERENCES

Illustrated in co-pending U.S. Ser. No. 10/422,668, filed Apr. 24, 2003, by Robert Yu et al., the disclosure of which is totally incorporated herein by reference, is a photoconductive imaging member containing a photogenerating layer, a charge transport layer, or a plurality of charge transport layers, and which charge transport, especially the top charge transport layer contains a vinyl containing organic compound.

U.S. Pat. No. 6,326,111, the disclosure of which is entirely incorporated by herein by reference, relates to a charge transport material for a photoreceptor includes at least a polycarbonate polymer, at least one charge transport material, polytetrafluoroethylene (PTFE) particle aggregates having an average size of less than about 1.5 microns, hydrophobic silica and a fluorine-containing polymeric surfactant dispersed in a solvent. The presence of the hydrophobic silica enables the dispersion to have superior stability by preventing settling of the PTFE particles. A resulting charge transport layer produced from the dispersion exhibits excellent wear resistance against contact with an AC bias charging roll, excellent electrical performance, and delivers superior print quality.

U.S. Pat. No. 6,337,166, the disclosure of which is totally incorporated by reference, discloses a charge transport material for a photoreceptor includes at least a polycarbonate polymer binder having a number average molecular weight of not less than 35,000, at least one charge transport material, polytetrafluoroethylene (PTFE) particle aggregates having an average size of less than about 1.5 microns, and a fluorine-containing polymeric surfactant dispersed in a solvent mixture of at least tetrahydrofuran and toluene. The dispersion is able to form a uniform and stable material ideal for use in forming a charge transport layer of a photoreceptor. The resulting charge transport layer exhibits excellent wear resistance against contact with an AC bias charging roll, excellent electrical performance, and delivers superior print quality.

U.S. Pat. No. 4,265,990, the disclosure of which is fully incorporated herein by reference, illustrates a layered photoreceptor having a separate charge generating layer and a separate charge transport layer. The charge generating layer is capable of photogenerating holes and injecting the photogenerated holes into the charge transport layer. The photogeneratihg layer utilized in multilayered photoreceptors includes, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,233,384; 4,306,008; 4,299,897; and, 4,439,507, the disclosures of each of these patents being totally incorporated herein by reference in their entirety.

U.S. Pat. No. 5,096,795, the disclosure of which is incorporated herein by reference in its entirety, provides a disclosure of preparation of multilayered photoreceptor containing particulate materials for the exposed layers in which the particles are homogeneously dispersed therein. The particles renders coefficient of surface contact friction reduction, increased wear resistance, durability against tensile cracking, and improved adhesion of the layers without adversely affecting the optical and electrical properties of the resulting photoreceptor.

U.S. Pat. No. 5,069,993 issued to Robinette et al on Dec. 3, 1991. The disclosure of this reference is also totally incorporated herein by reference. An exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder.

U.S. Pat. No. 5,830,614, the disclosure of which is further fully incorporated herein by reference, relates to a charge transport having two layers for use in a multilayer photoreceptor. The photoreceptor comprises a support layer, a charge generating layer, and two charge transport layers. The charge transport layers consist of a first transport layer comprising a charge transporting polymer (consisting of a polymer segment in direct linkage to a charge transporting segment) and a second transport layer comprising a same charge transporting polymer except that it has a lower weight percent of charge transporting segment than that of the first charge transport layer. In the '614 patent, the hole transport compound is connected to the polymer backbone to create a single giant molecule of hole transporting polymer.

However, while many of the abovementioned references attempt to offer solutions to the problems noted, they frequently create new ones. Therefore, notwithstanding the above, there remains a need to provide improved layer(s) of an imaging member that exhibits enhanced mechanical performance properties and which is more resistance to premature mechanical failures caused by chemical or ozone attack, mechanical wear, and electrical stresses; has enhanced photoelectrical performance; and renders a reduced imaging member residual solvent content in the charge transport layer. Such imaging members also have an increased service life.

BRIEF DESCRIPTION

There are disclosed in various embodiments herein, processes and compositions for extending the functional life of an electrophotographic imaging member. These processes and compositions relate generally to a mechanically robust charge transport layer which has increased wear resistance to increase imaging member service life under normal functioning conditions in the field.

In one embodiment, the electrophotographic imaging member has a charge transport layer comprises a charge transport compound, a film-forming polymer resin binder, an organic high boiler liquid, and a particulate dispersion.

In another embodiment, the charge transport layer comprises a charge transport compound, a film-forming polymer resin binder, a particulate dispersion, and a liquid oligomer carbonate, such as an allyl carbonate resin.

In a further embodiment, the particulate dispersion comprises polytetrafluoroethylene (PTFE) particles.

In still another embodiment, the organic high boiler liquid contains vinyl (or allyl) groups.

In still a further exemplary embodiment, the organic high boiler liquid is an unsaturated oligomer carbonate compound represented by Formula (I):

FORMULA (I)

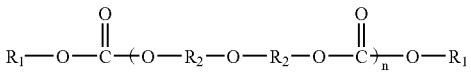

wherein $R_1$ is alkenyl having from about 2 to about 5 carbon atoms; $R_2$ is alkyl having from about 2 to about 3 carbon atoms, and n is an integer from about 1 to about 6.

In another exemplary embodiment, the organic high boiler liquid of Formula (I) is a diethylene glycol bis(allyl carbonate) represented by Formula (II):

FORMULA (II)

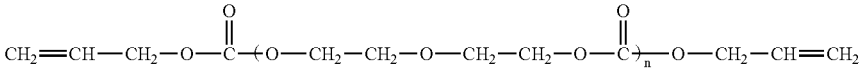

wherein n is an integer from about 1 to about 6.

In an additional exemplary embodiment, the organic high boiler liquid is an unsaturated oligomer aromatic carbonate represented by Formula (III):

FORMULA(III)

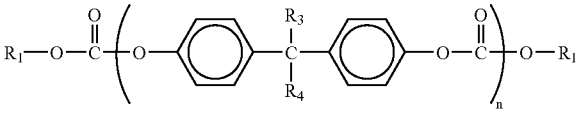

wherein $R_1$ is alkenyl having from about 2 to about 5 carbon atoms, $R_3$ and $R_4$ are independently alkyl having from about 1 to about 3 carbon atoms, and n is an integer from about 1 to about 6.

In a further exemplary embodiment, the organic high boiler liquid of Formula (III) is a monomer carbonate. In another embodiment, for $R_3$ being a methyl and same as $R_4$ while $R_1$ is an allyl, Formula (III) becomes a bis(allyl carbonate) of Bisphenol A shown as Formula (IV) below:

FORMULA (IV)

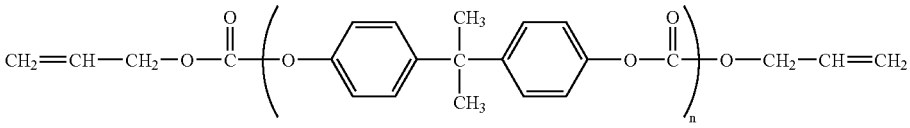

wherein n is an integer from about 1 to about 6.

In other embodiments, the charge transport layer comprises dual layers or multiple layers. Each layer may contain the organic high boiler liquid or only the outermost layer may contain the organic high boiler liquid.

A process for making such a charge transport layer and/or imaging member comprising the same is provided. The process comprises forming a coating solution. The coating solution comprises a charge transport compound, a film-forming polymer resin binder, an organic high boiler liquid, and an organic solvent. The coating solution further comprises a particulate dispersion. The coating solution is then applied to the surface of a charge generating layer and dried to form a charge transport layer as disclosed.

These and other non-limiting features and characteristics of the present disclosure are described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION OF THE DRAWINGS

Figure 1:
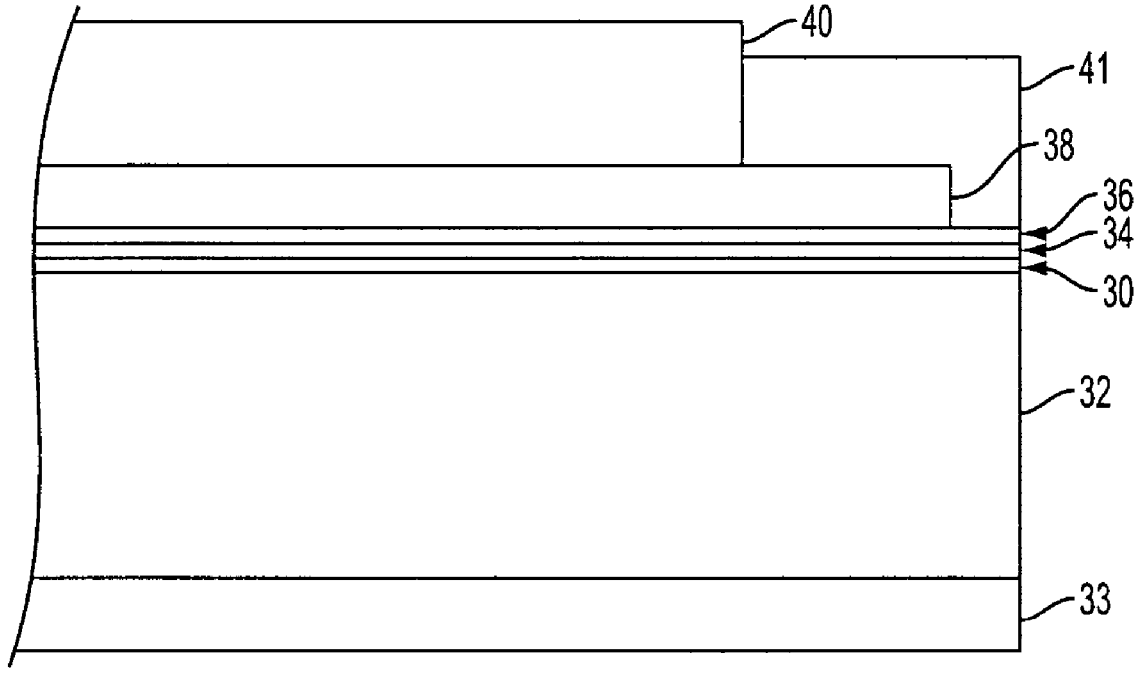
FIG. 1 is a schematic cross-sectional view of an exemplary embodiment of an imaging member having a single layer charge transport layer.

The imaging members of this development can be used in a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are also useful in color xerographic applications, particularly high-speed color copying and printing processes. In these applications, the imaging members are in embodiments sensitive in the wavelength region of from about 500 to about 900 nanometers, and in particular from about 650 to about 850 nanometers; thus, diode lasers can be selected as the light source.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the Figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

An exemplary embodiment of the imaging member of the present disclosure is illustrated in FIG. 1. The substrate 32 has an optional conductive layer 30. An optional hole blocking layer 34 can also be applied, as well as an optional adhesive layer 36. The charge generating layer 38 is located between the adhesive layer 36 and the charge transport layer 40. An optional ground strip layer 41 operatively connects the charge generating layer 38 and the charge transport layer 40 to the conductive layer 30. An anti-curl back layer 33 is applied to the side of the substrate 32 opposite from the electrically active layers to render imaging member flatness.

Figure 2:
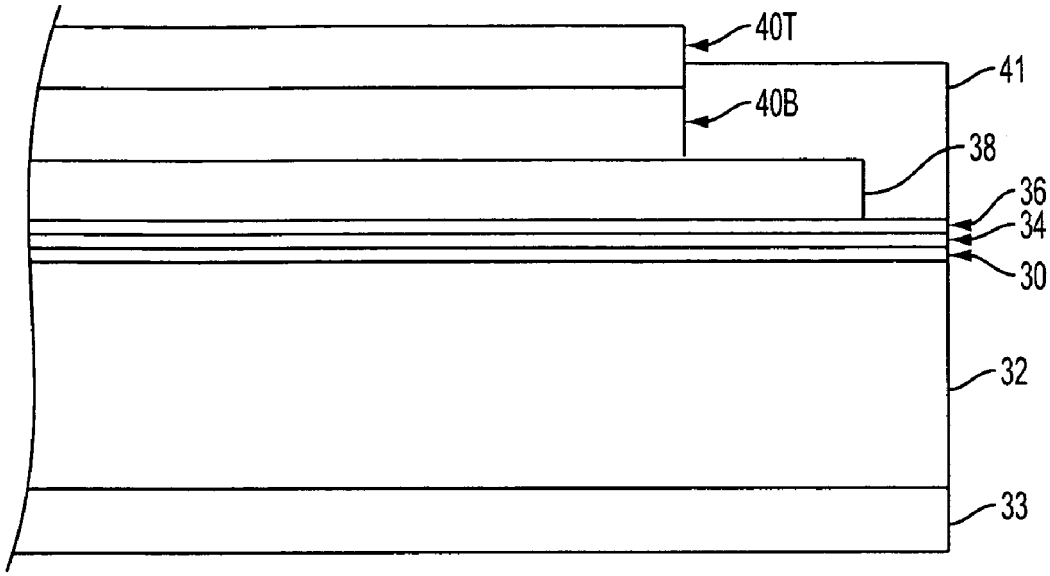
FIG. 2 is a schematic cross-sectional view of another exemplary embodiment in which the imaging member contains dual charge transport layers.

In another exemplary embodiment as illustrated in FIG. 2, the charge transport layer comprises dual charge transport sublayers 40B and 40T. The dual sublayers 40B and 40T may have the same or different compositions.

Figure 3:
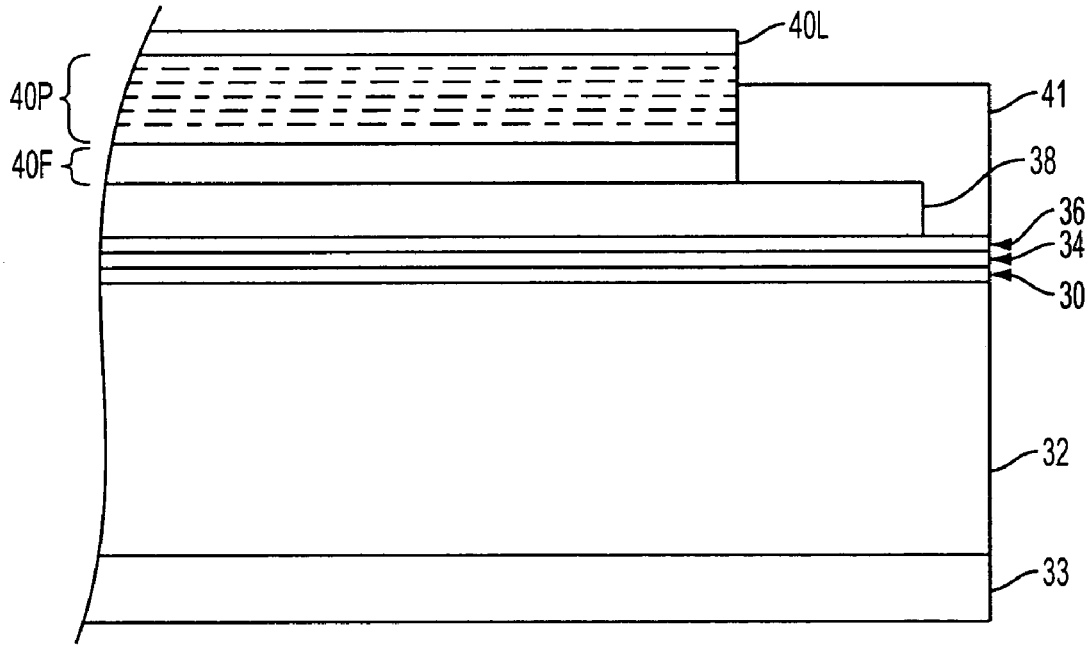
FIG. 3 is a schematic cross-sectional view of an additional exemplary embodiment of an imaging member. The imaging member, as illustrated, comprises multiple charge transport layers.

In another exemplary embodiment as illustrated in FIG. 3, the charge transport layer comprises a first (or bottom) charge transport sublayer 40F, one or more intermediate charge transport sublayers 40P, and a last or outermost charge transport sublayer 40L at the very top. Each sublayer of the charge transport layer may have the same or different compositions. Note that in these three Figures, the charge transport layer is the outermost layer of the imaging member and is therefore exposed to the operating environment of the machine. However, an overcoat layer (not shown) may also be optionally applied over the charge transport layer to further protect the imaging member.

The charge transport layer 40 of FIG. 1 may comprise any material capable of supporting the injection of photogenerated holes or electrons from the charge generating layer 38 and allowing their transport holes through the charge transport layer to selectively discharge the surface charge on the imaging member surface. The charge transport layer, in conjunction with the charge generating layer, should also be an insulator to the extent that an electrostatic charge placed on the charge transport layer is not conducted in the absence of illumination. It should also exhibit negligible, if any, discharge when exposed to a wavelength of light useful in xerography, e.g., about 4000 Angstroms to about 9000 Angstroms. This ensures that when the imaging member is exposed, most of the incident radiation is used charge generating layer beneath it to efficiently produce photogenerated holes. Typically, the charge transport layer has a thickness of from about 10 to about 40 micrometers, a Young's Modulus in the range of from about $3.0\times10^5$ psi to about $4.5\times10^5$ psi, and a thermal contraction coefficient of from about $6\times10^{-5}$/° C. to about $8\times10^{-5}$/° C.; it also has a glass transition temperature Tg of from about 75° C. to about 100° C.

The charge transport layer comprises a charge transport compound which supports the injection and transport of photogenerated holes or electrons. Examples of charge transport compounds include, but are not limited to, triphenylmethane; bis(4-diethylamine-2-methylphenyl) phenylmethane; stilbene; hydrazone; an aromatic amine comprising tritolylamine; arylamine; enamine phenanthrene diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N', N'-tetra[4-(1-butyl)-phenyl]-[p-terphenyl]-4,4'-diamine; N,N,N',N'-tetra[4-t-butyl-phenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; 4,4'-bis(diethylamino)-2,2'-dimethyltriphenylmethane; N,N'-diphenyl-N,N'-bis(3-methylphenyl)-[1,1'-biphenyl]- 4,4'-diamine; N,N'-diphenyl-N,N'-bis(alkylphenyl)-1,1'-biphenyl-4,4'-diamine; and N,N'-diphenyl-N,N'-bis(chlorophenyl)-1,1'-biphenyl4,4'-diamine. Combinations of different charge compounds are also contemplated so long as they are present in an effective amount. In further embodiments, the charge transport compound is a diamine represented by the molecular structure A below:

Structure A

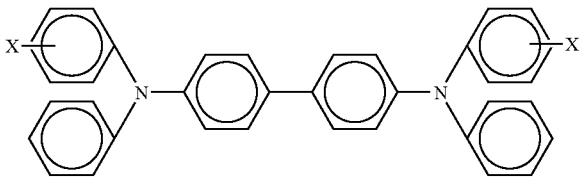

wherein X is selected from the group consisting of alkyl, hydroxy, and halogen. Such diamines are disclosed in U.S. Pat. Nos. 4,265,990, 4,233,384, 4,306,008, 4,299,897 and 4,439,507; these disclosures are herein incorporated in their entirety for reference.

The charge transport compound may comprise from about 10 to about 90 wt-% of the charge transport layer, based on the total weight of the charge transport layer. In an exemplary embodiment, the charge transport compound comprises from about 35 to about 75 wt-% or from about 60 to about 70 wt-% of the charge transport layer for optimum function. In embodiments where the charge transport layer comprises dual or multiple sublayers, as in FIGS. 2 and 3, the amount in each sublayer may be different. In one embodiment where the charge transport layer comprises multiple sublayers, the amount in each sublayer may be stepwise reduced so that the least amount of charge transport compound is present in the outermost exposed sublayer. For example, first sublayer 40F of FIG. 3 may comprise from about 50 to about 90 wt-% of charge transport compound, based on the total weight of the first sublayer. The intermediate sublayers 40P would comprise from about 40 to about 60 wt-% charge transport compound, based on the weight of each intermediate sublayer, wherein the amount in each sublayer is stepwise reduced, and the last sublayer 40L would comprise from about 10 to about 30 wt-% charge transport compound, based on the total weight of the first sublayer.

The charge transport layer further comprises a film-forming polymer binder resin which, when dried, forms a polymer matrix. The polymer binder should be soluble in methylene chloride, chlorobenzene, or some other solvent suitable for use in the manufacturing process. Typically, the polymer is a thermoplastic organic polymer including, but not limited to, polycarbonate, polystyrene, polyester, polyarylate, polyacrylate, polyether, polysulfone, and the like. The weight average molecular weight of the polymer binder can vary from about 50,000 to about 2,500,000. In embodiments, the polymer binder is either a poly(4,4'-isopropylidene diphenyl carbonate) or a poly(4,4'-diphenyl-1,1'-cyclohexane carbonate). The polymer binder may comprise from about 10 to about 90 wt-% of the charge transport layer, based on the weight of the charge transport layer, especially in embodiments where the charge transport layer comprises multiple sublayers. In an exemplary embodiment, the polymer binder comprises from about 25 to about 65 wt-% of the charge transport layer.

The charge transport layer further comprises an organic high boiler liquid. The high boiler liquid is selected to be compatible with both the charge transport compound and the polymer binder to prevent phase separation both in the coating solution and in the dried charge transport layer. In another embodiment, the high boiler liquid also contains vinyl or allyl groups, which act as an anti-ozonant to prevent the polymer binder from breaking down due to ozonolysis. The high boiler liquid should have a boiling point greater than 200° C. Some high boiler liquids may have a boiling point greater than 250° C. In some embodiments, the high boiler liquid has a boiling point of from about 260° C. to about 330° C. The high boiler liquid effectively flushes out any residual solvent remaining from the coating solution after it has been applied to the imaging member and dried; such residual solvent has a boiling point much lower than the high boiler liquid. This reduces internal strain due to residual solvent outgassing. The high boiler liquid is usually a monomer or oligomer carbonate.

In one exemplary embodiment, the high boiler liquid is a carbonate represented by Formula (I):

FORMULA (I)

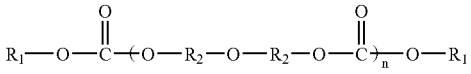

wherein $R_1$ is alkenyl having from about 2 to about 5 carbon atoms; $R_2$ is alkyl having from about 2 to about 3 carbon atoms; and n is an integer of from about 1 to about 6.

In another embodiment, the high boiler liquid of Formula (I) is a diethylene glycol bis(allyl carbonate) represented by Formula (II):

FORMULA (II)

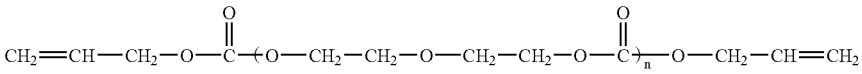

wherein n is an integer of from about 1 to about 6.

In another exemplary embodiment, the high boiler liquid is an aromatic carbonate represented by Formula (III):

FORMULA(III)

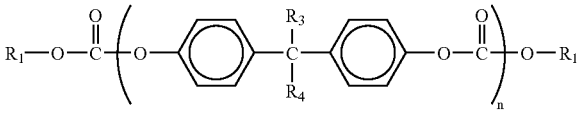

wherein $R_1$ is alkenyl having from about 2 to about 5 carbon atoms, $R_3$ and $R_4$ are independently alkyl having from about 1 to about 3 carbon atoms; and n is an integer from about 1 to about 6.

If R1 is allyl and R3 and R4 are methyl, then the carbonate of Formula (III) is an oligomer Bisphenol A carbonate. In another embodiment, the high boiler liquid is therefore a bis(allyl carbonate) of Bisphenol A represented by Formula (IV):

FORMULA (IV)

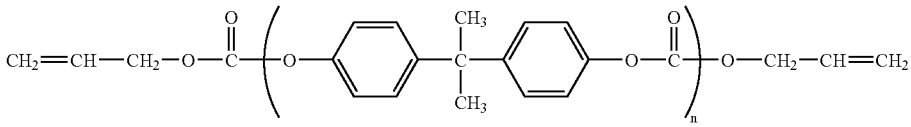

wherein n is an integer from about 1 to about 6.

Other oligomers of aromatic carbonate derived from Bisphenol A and suitable for the organic high boiler liquid are those oligomers represented by Formulas (V)-(VII) wherein n is an integer from about 1 to about 6:

Formula (V)

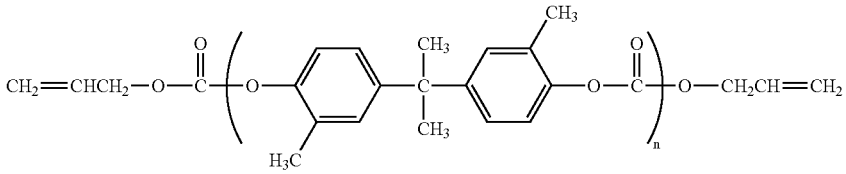

Formula (VI)

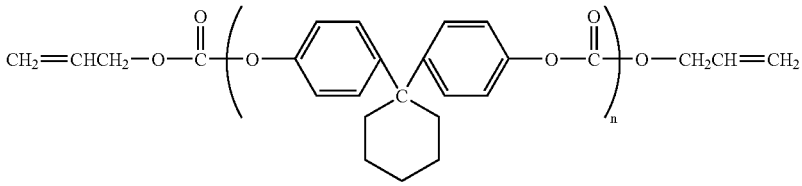

Formula (VII)

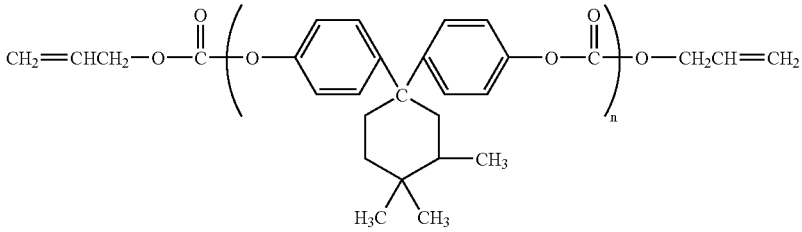

The organic high boiler liquid may also be a low molecular weight polystyrene with a vinyl end group as represented by Formula (VIII):

Formula (VIII)

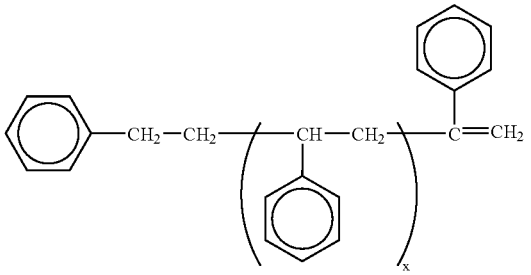

wherein x is the degree of polymerization which is an integer of from about 1 to about 20. In embodiments, x is from about 7 to about 15.

The organic high boiler liquid comprises from about 0.5 to about 15 wt-% or from about 2 to about 10 wt-% of the charge transport layer, based on the total weight of the charge transport layer. In other embodiments, it comprises from about 4 to about 8 wt-% of the charge transport layer. Mixtures of various high boiler liquids are also contemplated.

The charge transport layer may further comprise a particulate dispersion to increase wear resistance and photoelectrical performance. Suitable particulates may be organic and inorganic and the dispersion may be a blend of both organic and inorganic particles. Typical organic particulate materials include, but are not limited to, particles of polytetrafluoroethylene (PTFE), waxy polyethylene, waxy polypropylene, stearates, fatty amides, Kevlar™ (aromatic polyamide), and the like; inorganic materials include silica, silicate, calcium carbonate, metal oxides, zinc stearate, and the like. In one embodiment, the particulate dispersion is a PTFE dispersion. The particulates may have an average particle size of from about 0.1 to about 6 micrometers; however, nanoparticles of from about 3 to about 90 nanometers in average size may also be used. The particulates may have any shape, such as sphere or rod. The particulate dispersion may comprise from about 1 to about 10 wt-% or from about 2 to about 8 wt-% of the charge transport layer, based on the total weight of the charge transport layer. In an exemplary embodiment, the particulate dispersion comprises from about 2 to about 5 wt-% of the charge transport layer. A surfactant may also be added to the charge transport layer coating solution to facilitate homogeneous particulate dispersion. In embodiments where the charge transport layer comprises a particulate dispersion and an organic high boiler liquid, wear resistance is synergistically enhanced; therefore, a particulate dispersion is usually included. In one embodiment, the charge transport layer comprises from about 4 to about 8 wt-% organic high boiler liquid and from about 2 to about 5 wt-% particulate dispersion.

The charge transport layer may comprise additional components. An antioxidant, such as a hindered phenol or pentaerythritol tetrakis(3,5-di-tert-butyl-4-hydroxyphenyl) cinnamate (available as IRGANOX™ 1010), may be added. The antioxidant can comprise from about 1 to about 15 wt-% of the charge transport layer, .based on the total weight of the charge transport layer, but usually does not exceed 8 wt-%. In embodiment with multiple charge transport sublayers, the antioxidant can be present in a concentration gradient reversed from that of the charge transport compound. The charge transport layer may also contain a light shock resisting or reducing agent of from about 1 to about 6 wt-%. Such light shock resisting agents include 3,3',5,5'-tetra(t-butyl)-4,4'-diphenoquinone (DPQ); 5,6,11,12-tetraphenyl naphthacene (Rubrene); 2,2'-[cyclohexylidenebis[(2-methyl4,1-phenylene)azo]]bis[4-cyclohexyl-(9Cl)]; perinones; perylenes; and dibromo anthanthrone (DBA).

In embodiments where the charge transport layer comprises multiple sublayers, the specific material selected for each component of the sublayer may be independently selected for each sublayer. Typically, the same material is selected for each component of each sublayer and only the amount of the component is varied between sublayers. However, in some embodiments the outermost exposed charge transport layer (40T of the dual charge transport layers in FIG. 2 and the very top layer 40L of the multiple charge transport sublayers in FIG. 3) comprises components different from that of the other sublayers. For example, in one embodiment according to FIG. 3 sublayers 40F and 40P do not have the particulate dispersion, but sublayer 40L does.

In general, the ratio of the thickness of the charge transport layer to the charge generating layer is maintained from about 2:1 to about 200:1 and in some instances as great as about 400:1. However, the charge transport layer is generally from about 5 micrometers to about 100 micrometers thick. Thicknesses outside this range can also be used provided that there are no adverse effects.

In embodiments where the charge transport layer comprises multiple sublayers, the charge transport layer may have from about 2 to about 15 discreet sublayers, or from about 2 to about 7 layers, or from about 2 to about 3 sublayers. With reference to FIG. 3, the first or bottom charge transport sublayer 40F may be from about 5 to about 10 micrometers thick. Although the thickness of the first charge transport sublayer 40F may be the same as the collective or total thickness of the intermediate charge transport sublayers 40P, it is usually different. While the thickness of each of the intermediate charge transport sublayers 40P as well as the top sublayer 40L may be different, they are usually the same and range from about 0.5 to about 7 micrometers. Generally, the total thickness of a charge transport layer having dual or multiple ranges from about 10 to about 110 micrometers.

Any suitable technique may be used to mix and apply the charge transport layer coating solution onto the charge generating layer. Generally, the components of the charge transport layer are mixed into an organic solvent. Typical solvents comprise methylene chloride, toluene, tetrahydrofuran, and the like. Typical application techniques include extrusion die coating, spraying, roll coating, wire wound rod coating, and the like. Drying of the coating solution may be effected by any suitable conventional technique such as oven drying, infra red radiation drying, air drying and the like. When the charge transport layer comprises multiple sublayers, each sublayer is solution coated, then completely dried at elevated temperatures prior to the application of the next sublayer. This procedure is repeated for each sublayer to produce the charge transport layer.

The imaging members having the charge transport layer of the present disclosure avoid or minimize attacks by ozone species in the corona effluents to thereby minimize charge transport layer cracking, wear, and defects and deletions in the printed copy; and more specially; very importantly, wherein there is found to have a significant effect of suppressing polycarbonate binder in the charge transport layer from molecular chain scission caused by ozonolysis to en-brittle the charge transport layer and thereby shortening its mechanical functioning life. The mechanism of protecting the polymer binder from chain scission degradation against ozone attack, as a result of the incorporation of a vinyl (or allyl)

containing organic liquid described above into the charge transport layer, can be illustrated with reference to the chemical reaction below:

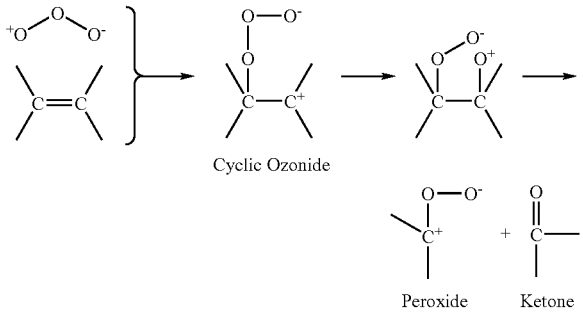

Referring to FIG. 1, the substrate support 32 provides support for all layers of the imaging member. Its thickness depends on numerous factors, including mechanical strength, flexibility, and economical considerations; the substrate for a flexible belt may, for example, be from about 50 micrometers to about 150 micrometers thick, provided there are no adverse effects on the final electrophotographic imaging device. The substrate support is not soluble in any of the solvents used in each coating layer solution, is optically transparent, and is thermally stable up to a high temperature of about 150° C. A typical substrate support is a biaxially oriented polyethylene terephthalate. Another suitable substrate material is a biaxially oriented polyethylene naphtahlate, having a thermal contraction coefficient ranging from about $1\times10^{-5}$/° C. to about $3\times10^{-5}$/° C. and a Young's Modulus of from about $5\times10^{5}$ psi to about $7\times10^{5}$ psi. However, other polymers are suitable for use as substrate supports. The substrate support may also be made of a conductive material, such as aluminum, chromium, nickel, brass and the like. Again, the substrate support may flexible or rigid, seamed or seamless, and have any configuration, such as a plate, drum, scroll, belt, and the like.

The optional conductive layer 30 is present when the substrate support 32 is not itself conductive. It may vary in thickness depending on the optical transparency and flexibility desired for the electrophotographic imaging member. Accordingly, when a flexible electrophotographic imaging belt is desired, the thickness of the conductive layer may be from about 20 Angstrom units to about 750 Angstrom units, and more specifically from about 50 Angstrom units to about 200 Angstrom units for an optimum combination of electrical conductivity, flexibility and light transmission. The conductive layer may be formed on the substrate by any suitable coating technique, such as a vacuum depositing or sputtering technique. Typical metals suitable for use as the conductive layer include aluminum, zirconium, niobium, tantalum, vanadium, hafnium, titanium, nickel, stainless steel, chromium, tungsten, molybdenum, and the like.

The optional hole blocking layer 34 forms an effective barrier to hole injection from the adjacent conductive layer into the charge generating layer. Examples of hole blocking layer materials include gamma amino propyl triethoxyl silane, zinc oxide, titanium oxide, silica, polyvinyl butyral, phenolic resins, and the like. Hole blocking layers of nitrogen containing siloxanes or nitrogen containing titanium compounds are disclosed, for example, in U.S. Pat. Nos. 4,291,110, 4,338,387, 4,286,033 and 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of from about 0.2 to about 2 micrometers.

An optional adhesive layer 36 may be applied to the hole blocking layer. Any suitable adhesive layer may be utilized. One well known adhesive layer includes a linear saturated copolyester consists of alternating monomer units of ethylene glycol and four randomly sequenced diacids in a ratio of four diacid units to one ethylene glycol unit and has a weight average molecular weight of about 70,000 and a T~ of about 32° C. If desired, the adhesive layer may include a copolyester resin. The adhesive layer including the polyester resin is applied to the blocking layer. Any adhesive layer employed should be continuous and, more specifically, have a dry thickness from about 200 micrometers to about 900 micrometers and, even more specifically, from about 400 micrometers to about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited coating may be effected by any suitable conventional technique such as oven drying, infra red radiation drying, air drying, and the like.

Any suitable charge generating layer 38 may be applied which can thereafter be coated over with a contiguous charge transport layer. The charge generating layer generally comprises a charge generating material and a film-forming polymer binder resin. Charge generating materials such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be appropriate because of their sensitivity to white light. Vanadyl phthalocyanine, metal free phthalocyanine and tellurium alloys are also useful because these materials provide the additional benefit of being sensitive to infrared light. Other charge generating materials include quinacridones, dibromo anthanthrone pigments, benzimidazole perylene, substituted 2,4-diamino-triazines, polynuclear aromatic quinones, and the like. Benzimidazole perylene compositions are well known and described, for example, in U.S. Pat. No. 4,587,189, the entire disclosure thereof being incorporated herein by reference. Other suitable charge generating materials known in the art may also be utilized, if desired. The charge generating materials selected should be sensitive to activating radiation having a wavelength from about 600 to about 700 nm during the imagewise radiation exposure step in an electrophotographic imaging process to form an electrostatic latent image.

Any suitable inactive film forming polymeric material may be employed as the binder in the charge generating layer 38, including those described, for example, in U.S. Pat. No. 3,121,006, the entire disclosure thereof being incorporated herein by reference. Typical organic polymer binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating material can be present in the polymer binder composition in various amounts. Generally, from about 5 to about 90 percent by volume of the charge generating material is dispersed in about 10 to about 95 percent by volume of the polymer binder, and more specifically from about 20 to about 30 percent by volume of the charge generating material is dispersed in about 70 to about 80 percent by volume of the polymer binder.

The charge generating layer generally ranges in thickness of from about 0.1 micrometer to about 5 micrometers, and more specifically has a thickness of from about 0.3 micrometer to about 3 micrometers. The charge generating layer thickness is related to binder content. Higher polymer binder content compositions generally require thicker layers for charge generation. Thickness outside these ranges can be selected in order to provide sufficient charge generation.

An optional anti-curl back coating 33 can be applied to the back side of the substrate support 32 (which is the side opposite the side bearing the electrically active coating layers) in order to render flatness. Although the anti-curl back coating may include any electrically insulating or slightly semi-conductive organic film forming polymer, it is usually the same polymer as used in the charge transport layer polymer binder. An anti-curl back coating from about 7 to about 30 micrometers in thickness is found to be adequately sufficient for balancing the curl and render imaging member flatness.

An electrophotographic imaging member may also include an optional ground strip layer 41. The ground strip layer comprises, for example, conductive particles dispersed in a film forming binder and may be applied to one edge of the photoreceptor to operatively connect charge transport layer 40, charge generating layer 38, and conductive layer 30 for electrical continuity during electrophotographic imaging process. The ground strip layer may comprise any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

The prepared flexible imaging member belt may then be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

Therefore, fabrication of robust imaging member for effectual service life extension is produced. The present approach has been developed and successfully demonstrated to yield imaging member service life improvements by providing a charge transport layer (1) free of internal strain through residual solvent reduction and (2) wear resistance enhancement using particulates dispersion and organic liquid incorporation; each of which is described in this disclosure.

The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Control Example 1

A flexible electrophotographic imaging member web was prepared by providing a 0.02 micrometer thick titanium layer coated on a substrate of a biaxially oriented polyethylene naphthalate substrate (KADALEX, available from DuPont Teijin Films.) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200, a polycarbonate of poly(4,4'-diphenyl)-1,1'-cyclohexane carbonate (PC-z 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer and a ground strip layer by co-extrusion of the coating materials. The charge transport layer was prepared by introducing into an amber glass bottle in a weight ratio of 1:1 (or 50 weight percent of each) of MAKROLON® 5705, a Bisphenol A polycarbonate thermoplastic having a molecular weight of about 120,000 commercially available from Farbensabricken Bayer A.G. and N,N'-diphenyl-N,N'-bis(3-methylphenyl)-1,1 '-biphenyl4,4'-diamine, a charge transport compound.

The resulting mixture was dissolved to give 15 percent by weight solid in methylene chloride. This solution was applied on the charge generating layer by extrusion to form a coating which upon drying in a forced air oven gave a charge transport layer 29 micrometers thick.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip.

An anti-curl coating was prepared by combining 88.2 grams of polycarbonate resin (MAKROLON® 5705), 7.12 grams VITEL PE-200 copolyester (available from Goodyear Tire and Rubber Company) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 125° C. in a forced air oven for 3 minutes to produce a dried coating layer having a thickness of 17 micrometers and flatten the imaging member.

Control Example 2

A flexible electrophotographic imaging member web was prepared in the same manner and using the same materials as those described in Control Example 1, except that the 29 micrometers thick charge transport layer was prepared to include a 5 wt-% nanoparticle PTFE (MP1100, available from DuPont) dispersion.

Disclosure Example 1

Two flexible electrophotographic imaging member webs were fabricated using the same materials and the same process as that described in Control Example 2, except that the charge transport layer coating solutions were prepared to include a Bisphenol A bisallyl carbonate monomer (HIRI®; commercially available from PPG, Inc.), an organic high boiler liquid. The two coating solutions were then each applied onto the charge generating layer of an imaging memberweb and followed by subsequent drying at elevated temperature to give two imaging member web stocks having 2 wt-% HIRI® and 8 wt-% HIRI®, respectively, based on the resulting dried weight of each charge transport layer. The charge transport layer of each web was 29 micrometers in thickness.

Disclosure Example 2

A flexible electrophotographic imaging member web was fabricated using the same materials and the same process as that described in the Disclosure Example 1, except that the charge transport layer -coating contained 5 wt-% nano particle PTFE dispersion and 5 wt-% HIRI®. The charge transport layer was also 29 micrometers thick.

Residual Solvent and Tg Determinations

The prepared electrophotographic imaging member web stocks of Control Example 1 and Disclosure Example 1 (each having a single charge transport layer) were analyzed for residual methylene content in their charge transport layer. The glass transition temperature (Tg) of the charge transport layer was also determined by differential scanning calorimetry measurement (DSC) to assess the impact of HIRI® on Tg suppression of the resulting charge transport layer. The results are presented in Table A below:

TABLE A

| Imaging Member | Amount of HIRI ® in CTL | Residual Solvent in CTL | Tg of CTL (° C.) |
|---|---|---|---|
| Control Example 1 | None | 1.89 wt-% | 86 |
| Disclosure Example 1 | 2 wt-% | 0.33 wt-% | 84 |
| Disclosure Example 1 | 8 wt-% | 0.30 wt-% | 72 |

The data showed that incorporating HIRI® reduced the methylene chloride residue in the charge transport layer by about 85%. Even at a low 2 wt-% incorporation, the residual solvent was effectively flushed out.

Examination of the imaging members of both Control Example 1 and Disclosure Example 1, after two months of standing at ambient room temperature to allow for residual solvent outgassing, found that the imaging member of Control Example 1 exhibited upward curling while the imaging members of Disclosure Example 1 maintained their flatness. Although incorporation of HIRI® was found to cause Tg depression of the charge transport layer, nonetheless even the maximum Tg reduction to 72° C. seen for the charge transport layer containing 8 wt-% HIRI® would not cause any practical impact on the imaging member's performance because the Tg is still much higher than the typical imaging machine's functioning temperature of 45° C. in the field. Furthermore, it is also important to note that the mechanical properties, such as Young's Modulus, ultimate strength, break elongation, and surface coefficient of friction of the charge transport layer formulated according to Disclosure Example 1 were not substantially affected by the incorporation of 2 and 8 wt-% HIRI®.

Photoelectrical and Ozone Exposure Testing

The imaging member webs of Control Example 1 and Disclosure Example 1 were tested to determine the effect of incorporating a high boiler liquid on photoelectrical properties.

The photoelectrical testing results obtained from the electrical scanner showed that electrophotographic imaging members containing HIRI® exhibited equivalent electrical functional characteristics, such as photoelectrical cyclic stability, charge acceptance, photo induce discharge sensitivity, dark decay potential, depletion voltage, and background and residual voltage compared to their respective imaging member control counterpart. These results indicate that the incorporating a high boiler liquid into the charge transport layer would not cause deleterious photoelectrical impacts that affect imaging member function, since HIR®I has a molecular structure that is substantial the same as the MAKROLON® binder in the charge transport layer.

To assess the extent of polycarbonate degradation as a result of ozone exposure, two sets of two freestanding coatings were prepared by solution casting. The coatings were 20 micrometers thick. Each set contained one coating of pure MAKROLON® and one coating of MAKROLON® with 5wt-% HIRI® incorporated. One set was subjected to an ozone exposure test from corona effluent and the other unexposed set was used as a control. Corona effluents were generated by turning on a charging device in an enclosed large glass tubing operated under 700 micro-amperes and 8 KV conditions. The corona effluent exposure test was accomplished by placing each coating inside the enclosed glass tube and simultaneously exposing the coating to the gaseous effluents generated by the charging device for 6 hours. All four coatings were then analyzed for molecular weight distribution by Gel Permeation Chromatography (GPC). The results are given in Table B below:

TABLE B

| SAMPLE ID | Mw (Kpse) | Mn (Kpse) | Mp (Kpse) |
|---|---|---|---|
| Makrolon/HIRI ® corona exposed | 90.7 | 4.1 | 133 |
| Makrolon/HIRI ® control (unexposed) | 163 | 37 | 146 |
| Makrolon corona exposed | 30.1 | 4.9 | 37.6 |
| Makrolon control (unexposed) | 163 | 40 | 140 |

In the above table, Mw is weight average molecular weight, Mn is number average molecular weight, and Mp is the peak molecular weight. The data showed that molecular degradation caused by ozone attack in the pure MAKROLON® coating was significant, while addition of HIRI® in MAKROLON® provided effective protection against polymer chain scission caused by ozonolysis as seen in the Mw and Mn columns.

The experimental study to determine: (a) the true impact of ozone attack on the charge transport layer mechanical degradation of the imaging member and (2) effectiveness of HIRI® liquid carbonate to suppress/minimize ozone induced polymer chain scission on the impact of-charge transport wear life extension were carried out by corona effluents/imaging member exposure test as described below:

The corona effluent exposure test was performed on imaging members after being left standing for two months. The imaging members of Control Examples 1 and 2, along with the imaging members of Disclosure Examples 1 and 2, were first allowed to sit on the shelf for 2 months and then cut to provide two sets of two 1"×12" test samples from each of these four imaging members. Each of the imaging member test samples, laid down in flat configuration (without bending) on a surface of a support with the charge transport layer facing upwardly, was then subjected to a corona effluent exposure test. Corona effluents were generated by turning on a charging device in an enclosed large glass tubing operated under 700 micro-amperes and 8 KV conditions. One set of each imaging member test sample was placed inside the enclosed glass tube and the samples were simultaneously exposed to the gaseous effluents generated by the charging device for 6 hours. Examination of each of these test samples, under 70× magnification with an optical microscope, after exposure, found that all the test samples, of both the Control Examples 1 and 2 and the Disclosure Examples 1.and 2, did not develop cracking in their charge transport layer even though MAKROLON® chain scission did occur as a result of ozone attacking the layer; this was due to the fact that the test samples were exposure tested with each samples being laid down under flat configuration condition free of bending strain.

To assess the impact of polymer degradation on the wear properties of the charge transport layer (CTL), both the exposed and unexposed imaging member samples were then subjected to wear testing.

The wear testing of each of the electrophotographic imaging member test samples after corona exposure was conducted by means of a dynamic mechanical cycling device in which glass tubes were skidded across the surface of the charge transport layer on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch (0.17 kilogram per cm) width tension on the sample. The outer surface of the imaging member cut piece bearing the charge transport layer faced downwardly so that it would periodically be brought into sliding mechanical contact with the glass tubes to effect wear. The glass tubes had an outer diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes -around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the charge transport layer (CTL) surface was away from the weighted end of the sample toward the end clamped to the stationary post. Since there were three glass tubes in the test device, each complete rotation of the disk was equivalent to three wear cycles in which the surface of the charge transport layer was in sliding mechanical contact with a single stationary support tube during the testing. The rotation of the spinning disk was adjusted to provide the equivalent of 11.3 inches (28.7 cm.) per second tangential speed. The extent of charge transport layer (CTL) wear was measured using a permascope at the end of a 90K wear cycles test. The results are given in Table C below:

TABLE C

| SAMPLE ID (after exposure) | AMOUNT PTFE IN CTL | AMOUNT HIRI ® IN CTL | CTL WORN OFF BY 90K wear cycles |
|---|---|---|---|
| Control 1 | none | none | 4.2 microns |
| Control 2 | 5 wt-% | none | 2.6 microns |
| Disclosure 1 | none | 8 wt-% | 2.9 microns |
| Disclosure 2 | 5 wt-% | 5 wt-% | 1.9 microns |

The wear data, obtained for all these samples after corona exposure, showed that (1) addition of a PTFE dispersion provided substantial charge transport layer wear improvement; (2) addition of HIRI® improved wear resistance nearly equivalent to that of the 5 wt-% PTFE dispersion; and (3) a charge transport layer with both a PTFE dispersion and HIRI® incorporation gave synergistically superior wear enhancement outcome.

Additionally, it is also important to mention that CTL formulated to include addition of PTFE dispersion and the antiozonant HIRI® liquid carbonate to give outstanding wear resistance enhancement did not cause deleterious impact to the overall photo-electrical performance; neither was seen to affect the interfacial adhesion bonding strength between the charge transport layer and the charge generation layer.

Examples of Rigid Imaging Member Drum Preparation

Example A

Figure 4:
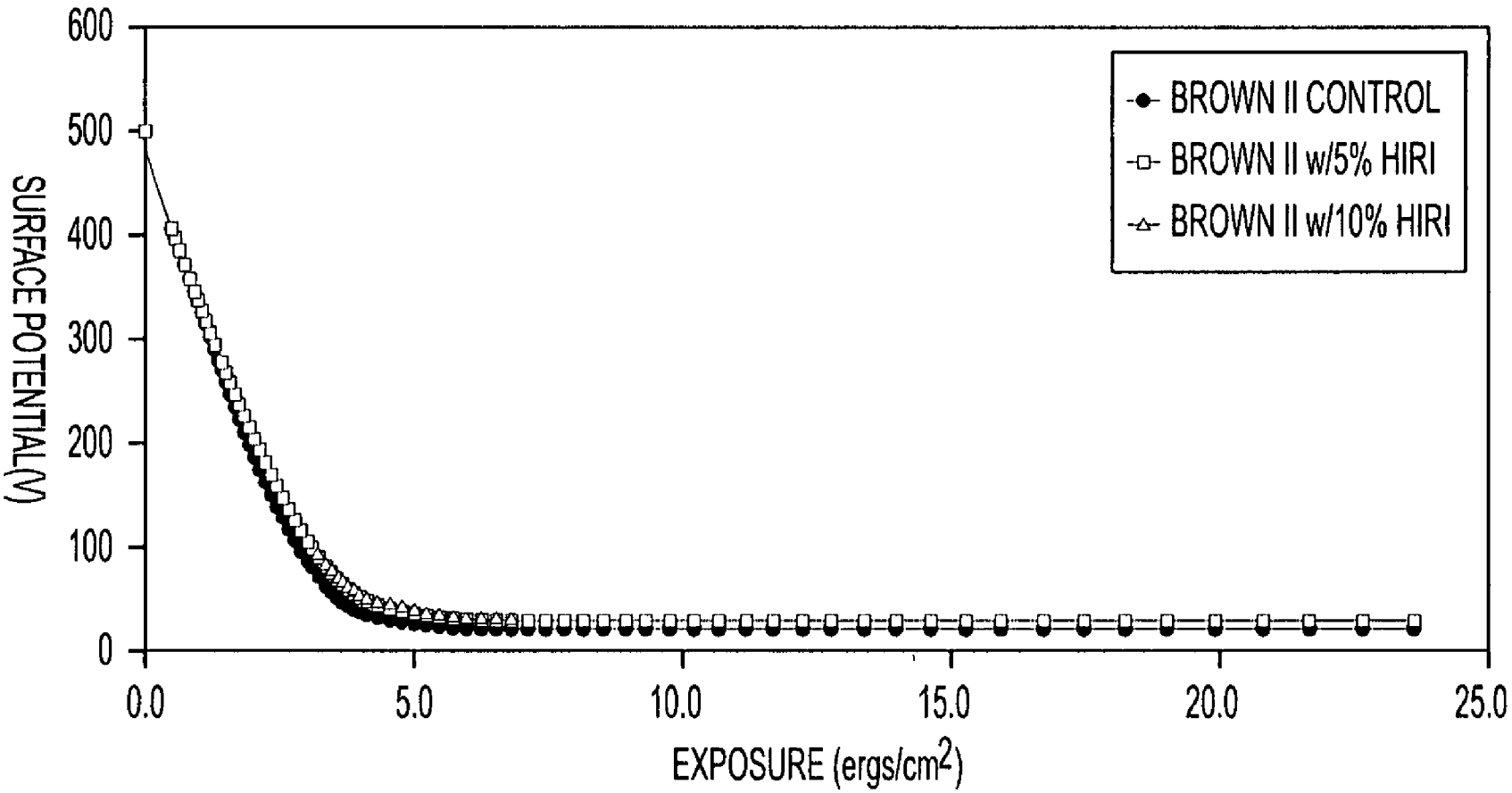
FIG. 4 is a graph illustrating the photo-induced discharge characteristics of an exemplary embodiment imaging member.

Initial studies have been completed in which a material solution of charge transport layer (CTL) comprised of a charge transporting molecule of N,N'-diphenyl-N,N'-bis (alkylphenyl)-1,1-biphenyl-4,4'-diamine and a polycarbonate was doped with 5% and 10% HIRI® to the solid content by weight. The HIRI® was added to the CTL and then allowed to roll overnight to ensure good mixing. The CTL's were then used in the coating of full photoreceptor devices where the CTLs comprised, in order of coating, a 4 μm titanium oxide based undercoating layer, a chlorogallium phthalocyanine based charge generation layer, and a 24 μm CTL. Both the 5% and 10% doped CTL's were coated at 24 um. A control device with standard CTL without the HIRI® dopant at 24 μm was also coated. These devices were electrically scanned and print tested at time zero. Photoelectrical properties of devices containing 0, 5%, or 10% HIRI® are all nominal, suggesting HIRI® is compatible to other components of the CTL and not inducing charge traps or phase boundary (FIG. 4). The devices were then placed in a wear test fixture for two sets of 50 kcycles each. The thickness of each device was monitored via Permiscope. Wear rate results indicate a 15-20% improvement when the CTL was doped with 5% or 10% HIRI®. After each 50 kcycle run the photoreceptor was taken from the fixture and print tested for background and ghosting in a Document Center 230ST printer. All the print tests completed gave background levels of 1.5 and ghosting grades of 0. The 1.5 background level was given since all the prints had a small amount of background, but not as much as the level 2 standard. All prints were comparable to the machine control prints and all showed good general print quality, suggesting the HIRI® is resistant to Bias Charging Roll (BCR) effect and does not incur any print degradations (Table D). A bias charging roll is an apparatus electrically connected to a current voltage source and comprised of a deformable conductive and maintained in contact with any given area of a photoreceptor imaging member to charge the imaging member.

TABLE D

| | | Print background and ghosting result for members having 0, 5, and 10% HIRI ® in CTL | | | | | |
|---|---|---|---|---|---|---|---|
| Print Test | HIRI | T = 0 | | T = 50K | | T = 100K | |
| Device | Loading (%) | Background | Ghost | Background | Ghost | Background | Ghost |
| 03217501SDC | 0 | 1.5 | 0 | 1.5 | 0 | 1.5 | 0 |
| 03217502SDC | 5 | 1.5 | 0 | 1.5 | 0 | na | na |
| 03217503SDC | 10 | 1.5 | 0 | 1.5 | 0 | 1.5 | 0 |
| macine ctrl | 0 | 1.5 | 0 | 1.5 | 0 | 1.5 | 0 |

Example B

In conclusion, more BCR resistance CTL by doping HIRI® resin has been proposed. A 15-20% improvement in BCR wear rate without any deterioration to print quality is observed when doped 5 or 10% HIRI® into a regular CTL. The process of adding HIRI is simple mixing and does not require any sophisticated and hard-to-maintain procedures such as PTFE CTL.

Figure 5:
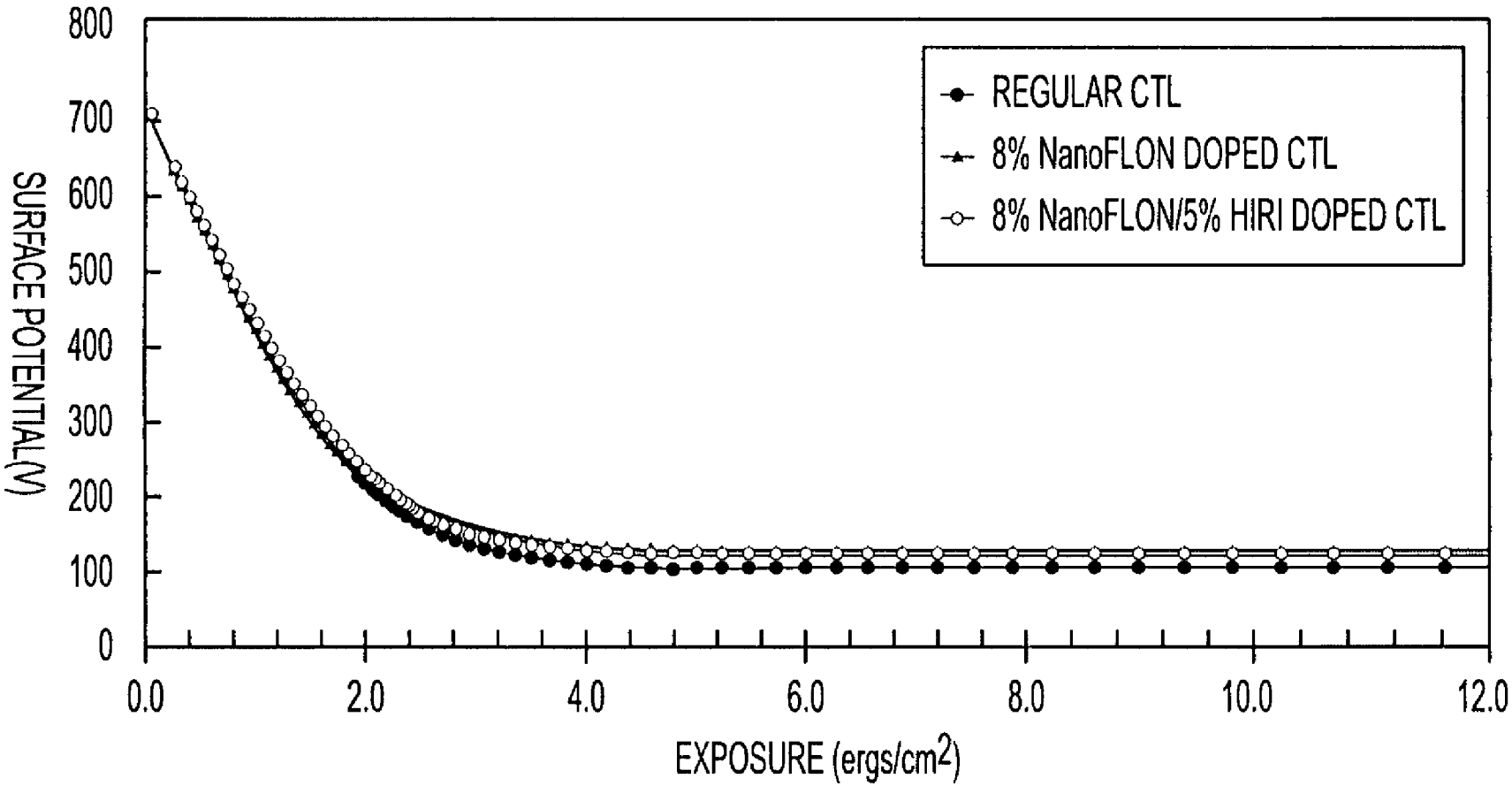
FIG. 5 is a graph illustrating the photo-induced discharge elements of another exemplary embodiment imaging member.

Details of the devices preparation are described here. The PTFE microparticles used was the recently identified nanoFLON P51A, manufactured by Shamrock Technologies. An about 100 g PTFE slurry was made by first mixing 20 gm of nanoFLON particles and 38.4 gm solution of 1% GF-300-a graft co-polymer surfactant manufactured by Togaosei Company known to dispersion PTFE particles-in THF and another 45 gm of THF overnight. Separately, a charge transport (CTL) solution consisted of 24 g of N,N'-diphenyl-N,N'-bis(alkylphenyl)-1,1-biphenyl4,4'-diamine and 36 gm of polycarbonate in 156 gm of THF and 84 gm toluene was mixed and allowed to dissolve. The PTFE slurry was processed in Cavpro 300, a homogenizer, for 3 passes then about 25 gm of the dispersion was added to the above solution, which then processed in the homogenizer for another two passes. The PTFE CTL dispersion was collected and yielded a solid content of about 18%. Subsequently, 0.3 gm of HIR®I I Casting resin (by PPG) was added to a 30 gm of PTFE CTL dispersion, which will be named as PTFE/HIR®I CTL dispersion hereafter, and allowed to mixed overnight. Separately, control samples were also made with a CTL solution similar to the above CTL solution but at a higher 22% solids and a PTFE CTL dispersion similar to the above PTFE CTL dispersion but at a solid of 20%. Several devices were coated with the above dispersions/solution on the same charge generating layer consisted of hydroxygallium phthalocyanine and vinyl chloride/acetate and undercoating layer consisted of silane, acetylacetonato zirconium, and polyvinyl butyral on 30 mm diameter aluminum pipes. Photoinduced discharged characteristics of the three devices are shown in FIG. 5 and it is obvious that incorporating nanoFLON and HIRI® does not affect photoelectrical properties since all have similar curves.

Table E summaries details of the photoelectrical properties which again indicate nominal properties for nanoFLON and HIRI®. Devices were charged to 700 V scanned ata RPM of 61.

TABLE E

Key Photoelectrical Properties of nanFLON and nanoFLON/HIRI ® Devices.

| Device | dV/dX ($Vcm^2$/ergs) | $V_L$(1.3 ergs) | $V_R$ | $V_{dep}$ |
|---|---|---|---|---|
| Reg. CTL | 290 | 350 | 88 | 77 |
| PTFE CTL | 292 | 352 | 90 | 80 |
| PTFE/HIRI CTL | 286 | 356 | 95 | 75 |

Figure 6:
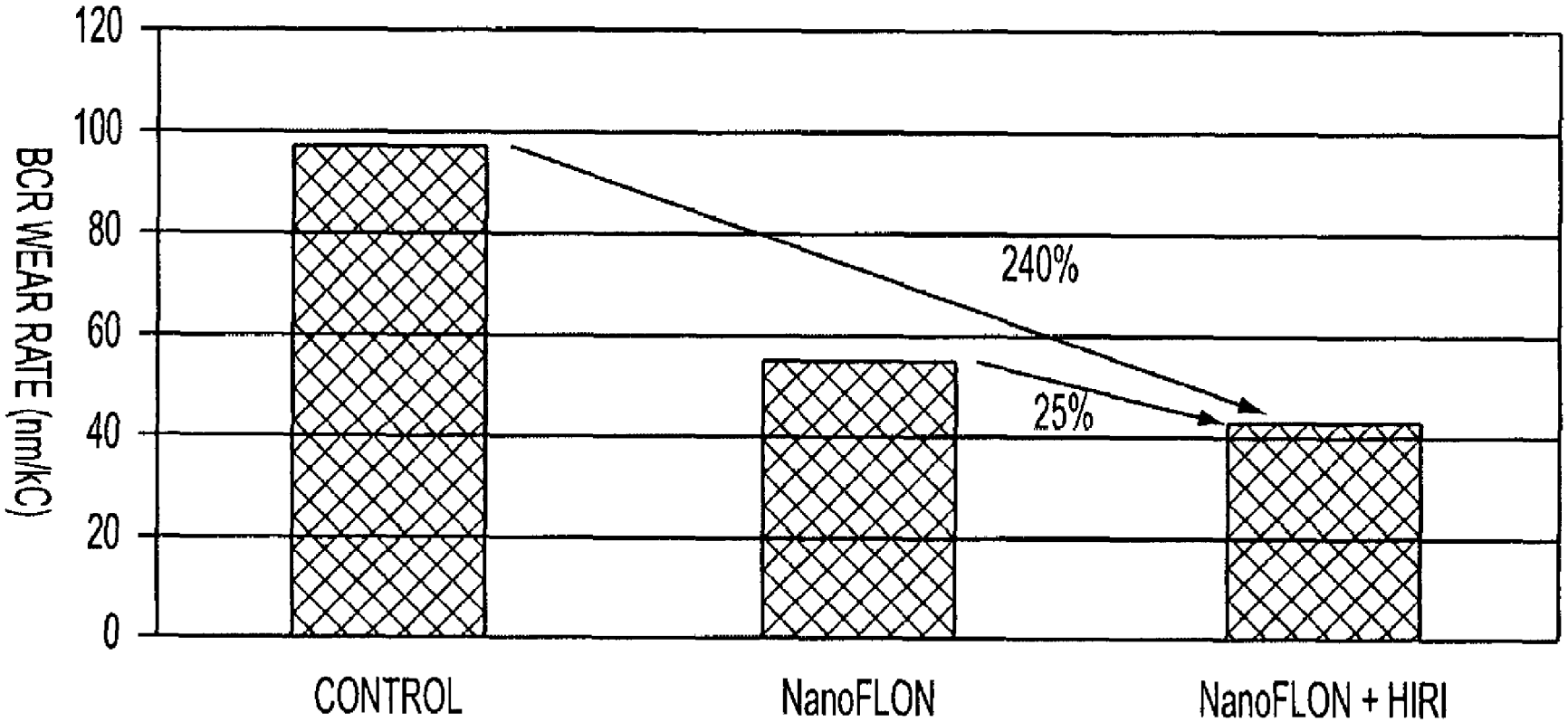
FIG. 6 is a chart showing the wear rate of an exemplary embodiment imaging member.

BCR wear rates for these devices were tested in a Hodaka wear test fixture with the same kind of cartridge and the results are shown in FIG. 6. A substantial 25% improvement in wear rate has been observed for the device with both nanoFLON and HIR®I over the one with only nanoFLON dopant. The nanoFLON/HIRI® device also has a 240% better wear rate than the device with regular CTL.

In conclusion, PTFE particles have been incorporated with a transparent thermal setting resin such as HIRI®I to improve wear-resistant of imaging members. The wear rate improvement is very significant without any apparent changes to key xerographic properties.

While particular embodiments have been described, alternatives, modifications, variations, improvements, and substantial equivalents that are or may be presently unforeseen may arise to applicants or others skilled in the art. Accordingly, the appended claims as filed and as they may-be amended are intended to embrace all such alternatives, modifications variations, improvements, and substantial equivalents.

The invention claimed is:

1. An electrophotographic imaging member having a charge transport layer comprising:

a charge transport compound;

a thermoplastic polymer binder resin;

a particulate dispersion; and an organic high boiler carbonate represented by Formula (V), (VI), or (VII)

Formula (V)

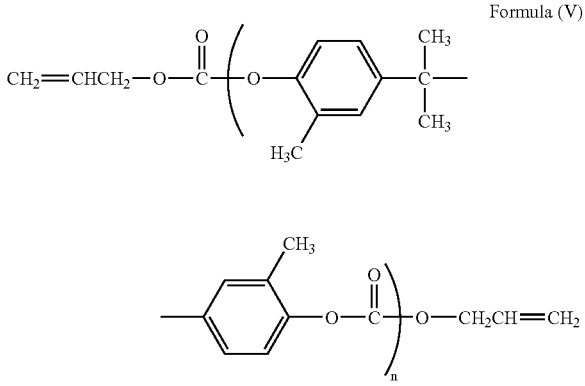

Formula (VI)

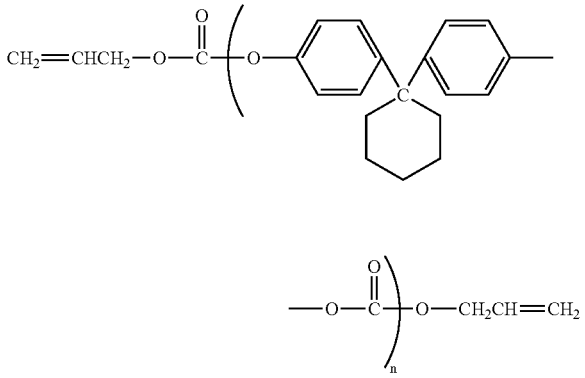

Formula (VII)

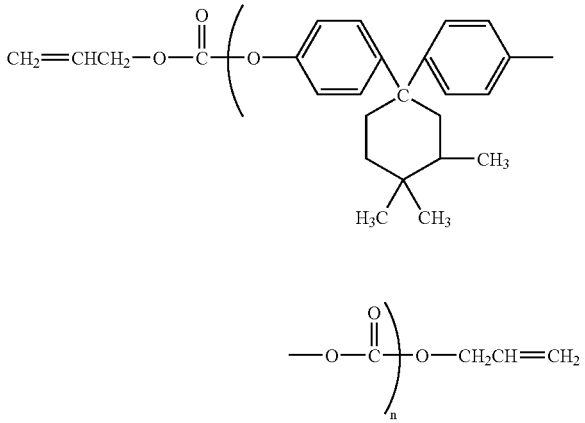

wherein n is an integer from about 1 to about 6.

2. The imaging member of claim 1, wherein the charge transport compound comprises from about 10 to about 90 weight percent of the charge transport layer, based on the total weight of the charge transport layer.

3. The imaging member of claim 1, wherein the polymer binder resin comprises from about 90 to about 10 weight percent of the charge transport layer, based on the total weight of the charge transport layer.

4. The imaging member of claim 1, wherein the organic high boiler liquid comprises from about 0.5 to about 15 weight percent of the charge transport layer, based on the total weight of the charge transport layer.

5. The imaging member of claim 1, wherein the charge transport compound is an aryl amine or diamine.

6. The imaging member of claim 1, wherein the particulate dispersion comprise from about 1 to about 10 weight percent of the charge transport layer, based on the total weight of the charge transport layer.

7. The imaging member of claim 1, wherein the particulate dispersion comprises organic or inorganic particulates having an average size of from about 0.1 to about 6.0 microns.

8. The imaging member of claim 7, wherein the organic particulate dispersion is a dispersion of particles selected from the group comprising PTFE, waxy polyethylene, waxy polypropylene, stearates, fatty amides, or aromatic polyamide.

9. The imaging member of claim 7, wherein the inorganic particulate dispersion is a silica, silicates, calcium carbonate, metal oxides, or zinc stearate dispersion.

10. The imaging member of claim 1, wherein the particulate dispersion comprises organic or inorganic particulates having an average particle size of from about 3 to about 90 nanometers.

11. The imaging member of claim 1, wherein the particulate dispersion is a PTFE dispersion.

12. The imaging member of claim 1, further comprising a component selected from the group consisting of an antioxidant and a light shock resisting agent.

13. The imaging member of claim 1, wherein the charge transport layer comprises multiple charge transport sublayers.

14. An electrophotographic imaging member having a thermoplastic charge transport layer comprising:

a charge transport compound;

a thermoplastic polymer film forming binder resin;

a particulate dispersion; and an organic high boiler carbonate;

wherein the particulate dispersion is a PTFE dispersion comprising from about 1 to about 5 weight percent of the charge transport layer, based on the total weight of the charge transport layer;

wherein the organic high boiler carbonate comprises from about 0.5 to about 15 weight percent of the charge transport layer, based on the total weight of the charge transport layer; and wherein the carbonate is represented by Formula (V), (VI), or (VII)

Formula (V)

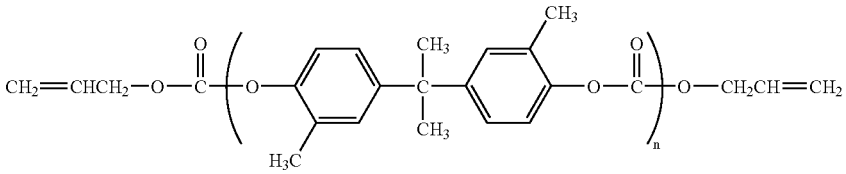

Formula (VI)

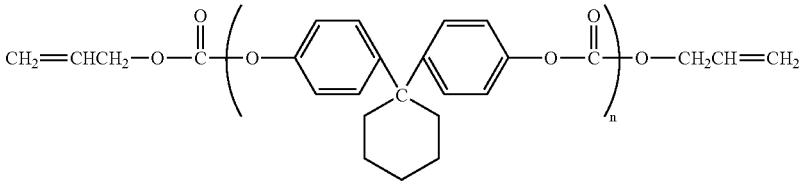

Formula (VII)

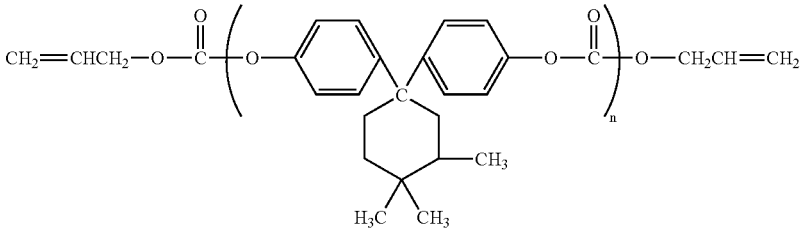

wherein n is an integer from about 1 to about 6.

15. The imaging member of claim 14, wherein the charge transport compound comprises from about 10 to about 90 weight percent of the charge transport layer, based on the total weight of the charge transport layer.

16. The imaging member of claim 14, wherein the polymer binder resin comprises from about 90 to about 10 weight percent of the charge transport layer, based on the total weight of the charge transport layer.

17. The imaging member of claim 14, wherein the organic high boiler liquid comprises from about 4 to about 8 weight percent of the charge transport layer, based on the total weight of the charge transport layer.

18. The imaging member of claim 14, wherein the charge transport compound is an aryl amine or diamine.

19. The imaging member of claim 14, wherein the charge transport layer comprises two or more layers including an outermost layer, and wherein the organic high boiler liquid and particulate dispersion are present in the outermost layer.

* * * * *